US006026723A

United States Patent [19]

Sakai

[11] Patent Number: 6,026,723

[45] Date of Patent: Feb. 22, 2000

[54] ROLL PAPER FEEDING APPARATUS

[75] Inventor: Katsuyuki Sakai, Nara, Japan

[73] Assignee: Sharp Kabushiki Kaisha, Osaka, Japan

[21] Appl. No.: 09/050,074

[22] Filed: Mar. 30, 1998

[30] Foreign Application Priority Data

Mar. 31, 1997 [JP] Japan ..... 9-079723

[51] Int. Cl.[7] ..... B26D 5/20; B41J 11/70

[52] U.S. Cl. ..... 83/221; 83/220; 83/235; 83/275; 358/304; 226/143

[58] Field of Search ..... 83/221, 275, 219, 83/220, 232, 233, 235, 257; 358/304; 226/143, 127

[56] References Cited

U.S. PATENT DOCUMENTS

| | | | |
|---|---|---|---|
| 4,193,329 | 3/1980 | Strunc | 83/250 |
| 4,676,131 | 6/1987 | Cassia | 83/208 |
| 4,839,732 | 6/1989 | Murakami et al. | 358/304 |
| 4,868,674 | 9/1989 | Nakamura et al. | 358/304 X |
| 4,967,285 | 10/1990 | Tabuchi | 358/304 |
| 5,072,306 | 12/1991 | Matsumoto et al. | 358/304 |
| 5,223,940 | 6/1993 | Matsumoto | 358/304 |
| 5,663,804 | 9/1997 | Kataoka et al. | 358/304 |
| 5,671,065 | 9/1997 | Lee | 358/304 |

FOREIGN PATENT DOCUMENTS 3004160 8/1994 Japan .

*Primary Examiner*—Rinaldi I. Rada
*Assistant Examiner*—Boyer Ashley

[57] ABSTRACT

An inventive apparatus for feeding rolled paper comprises rolled paper, a feed roller for feeding the rolled paper, a cutting unit for cutting the rolled paper, a driving source for actuating the feed roller and the cutting unit, a first gear train interposed between the driving source and the feed roller and a second gear train interposed between the driving source and the cutting unit. A reverse feed gear for transmitting driving force for a cutter gear to a feed gear is interposed between the first gear train and the second gear train and connects the first gear train with the second gear train when a movable cutter moves from a cutting position to a non-cutting position. Thereby, the feed roller is rotatively driven in the direction opposite to the feed direction by the driving force from the cutter gear.

9 Claims, 6 Drawing Sheets

ROLL PAPER FEEDING APPARATUS

BACKGROUND OF THE INVENTION

1. Field of the Invention

The present invention relates to an apparatus for feeding rolled paper which feeds the rolled paper in a predetermined manner.

2. Description of the Related Art

As a feeding apparatus for feeding rolled paper, there has been one disclosed in Japanese Utility Model Publication No. 3004160, for example. The apparatus disclosed in the publication comprises rolled paper, a feed mechanism for feeding the rolled paper in a predetermined direction and a cutting unit for cutting the paper pulled out of the rolled paper. The cutting unit has a fixed cutter and a movable cutter which is moved in relation to the fixed cutter. The movable cutter cuts the paper existing between them by moving from a non-cutting position to a cutting position.

This apparatus for feeding rolled paper is arranged so as to actuate the cutting unit and the feed mechanism by a common driving source. A first gear train is interposed between the driving source and the feed mechanism and a second gear train is interposed between the driving source and the cutting unit. In feeding the rolled paper, while the first gear train is held in a driving connection state, the second gear train is held in a driving connection release state. Thereby, driving force from the driving source is transmitted to the feed mechanism via the first gear train and the feed mechanism works on the rolled paper to feed it in a predetermined direction. In cutting the rolled paper, while the second gear train is held in a driving connection state, the first gear train is held in a driving connection rerlease state. Thereby, the driving force from the driving source is transmitted to the cutting unit and the movable cutter of the cutting unit moves from the non-cutting position to the cutting position.

Such an apparatus for feeding rolled paper has been required to pull in the tip end portion of the paper from the cutting position in the direction opposite to the feed direction when the movable cutter moves from the cutting position to the non-cutting position after cutting the paper. Otherwise, there has been a problem that the tip end portion of the paper hits with the movable cutter when the movable cutter returns, damaging the tip end of the paper or causing abnormal sound.

In order to eliminate the above-mentioned problem, a reverse mode of the cutter has been provided in addition to a normal mode of the cutter in the above-mentioned known feeding apparatus. In the normal mode of the cutter, the driving source is driven and rotated in the predetermined direction. Thereby, the movable cutter moves from the non-cutting position to the cutting position while holding the first gear train in the driving connection release state. In the reverse mode of the cutter on the other hand, the driving source is driven and rotated in the direction opposite to the predetermined direction. Thereby, the first gear train is put in the driving connection stat e and the movable cutter is returned from the cutting position to the non-cutting position. At this time, the feed mechanism is driven in the direction opposite to the predetermined direction.

However, the above -mentioned prior art feeding apparatus described above has had a problem to be solved. That is, because the normal mode of the cutter is performed and then the reverse mode of the cutter is performed in cutting the paper, it has been difficult to pull in the tip end of the rolled paper at high precision in connection with the move of the movable cutter and there has been a possibility that the tip end of the paper works on the movable cutter returning to the non-cutting position. Although such a problem might be eliminated by providing a sensor for detecting the cutting operation of the cutter, there has been a problem that the production cost increases when such a sensor is provided. Further, it has taken a long processing time for switching from the normal mode of the cutter to the reverse mode of the cutter and there has been a possibility that a communication failure occurs when such an apparatus for feeding rolled paper is applied to a facsimile, for example.

SUMMARY OF THE INVENTION

Accordingly, it is an object of the present invention to provide an apparatus for feeding rolled paper which can pull in the tip end portion of the rolled paper from a cutting position with high precision.

The invention provides an apparatus for feeding rolled paper and comprises, a feed mechanism for feeding an outer end portion of the rolled paper in a predetermined direction, a cutting unit for cutting the an outer end portion of the rolled paper into a sheet of desired length, a driving source for actuating the feed mechanism and the cutting unit, a first gear train interposed between the driving source and the feed mechanism and a second gear train interposed between the driving source and the cutting unit, wherein the first gear train includes a feed gear for driving the feed mechanism;

the second gear train includes a cutter gear f or moving a movable cutter of the cutting unit between a non-cutting position and a cutting position;

a reverse feed gear for transmitting driving force for the cutter gear to the feed gear is interposed between the first gear train and the second gear train;

when the an outer end portion of the rolled paper is to be fed, the second gear train is held in a non driving connection state and the first gear train is held in a driving connection state, thereby transmitting the driving force from the driving source to the feed mechanism via the first gear train and rotatively driving the feed mechanism in the predetermined direction;

when the an outer end portion of the rolled paper is to be cut, the second gear train is held in a driving connection state and the first gear train is held in a non driving connection state, thereby transmitting the driving force from the driving source to the movable cutter via the second gear train and moving the movable cutter from the non-cutting position to the cutting position and then from the cutting position to the non-cutting position; and when the movable cutter moves from the cutting position to the non-cutting position, the reverse feed gear connects the first gear train with the second gear train, thereby transmitting the driving force for the cutter gear to the feed gear via the reverse feed gear and rotatively driving the feed mechanism in the direction opposite to the predetermined direction.

According to the invention, the first gear train is interposed between the driving source and the feed mechanism, the second gear train is interposed between the driving source and the cutting unit and the reverse feed gear for transmitting the driving force for the cutter gear to the feed gear is interposed between the first gear train and the second gear train. Then, when the movable cutter moves from the cutting position to the non-cutting position by the driving force from the second gear train, the reverse feed gear connects the first gear train with the second gear train. Thereby, the driving force for the cutter gear is transmitted to the feed gear via the reverse feed gear. Accordingly, when the movable cutter returns to the non-cutting position, the feed mechanism is rotatively driven in the direction opposite to the predetermined direction and the tip end of the rolled paper is pulled in as required, so that the tip end of the rolled paper is prevented from abutting against the movable cutter.

The invention is also characterized in that the reverse feed gear is driven in a body with the cutter gear, a part of which is provided with a tooth portion which is drivingly connected with the first gear train, and the feed mechanism is rotatively driven in the direction opposite to the predetermined direction while the tooth portion of the reverse feed gear is connected with the first gear train.

According to the invention, the part of the reverse feed gear is provided with the tooth portion, and the reverse feed gear transmits the driving force to the feed gear while the reverse feed gear rotates in a body with the cutter gear and the tooth portion is drivingly connected to the first gear train. Accordingly, while the reverse feed gear engages with the first gear train, the feed mechanism is rotatively driven in the direction opposite to the predetermined direction and the tip end of the rolled paper may be reliably pulled with a relatively simple structure.

The invention is also characterized in that the reverse feed gear has one tooth and the feed mechanism is rotatively driven in the direction opposite to the predetermined direction when the one tooth engages with the first gear train.

According to the invention, since the reverse feed gear has one tooth and the feed mechanism slightly rotates in the direction opposite to the predetermined direction, it causes the tip end of the rolled paper to retreat slightly, preventing the tip end from abutting against the movable cutter.

The invention is characterized in that a link mechanism is interposed between the cutter gear and the movable cutter of the cutting unit and when the cutter gear is rotated once by the driving force from the second gear train, the movable cutter moves from the non-cutting position to the cutting position and then returns to the non-cutting position via the link mechanism.

According to the invention, because the link mechanism is interposed between the cutter gear and the movable cutter, the movable cutter moves from the non-cutting position to the cutting position and then returns to the non-cutting position by the work of the link mechanism.

The invention is also characterized in that a first lever is provided swingably between a first angular position and a second angular position with respect to the first gear train, a first planetary gear composing a part of the first gear train is attached rotatably to the first lever, the first planetary gear is positioned in the driving force transmitting path of the first gear train when the first lever is located at the first angular position, whereby the first gear train is held in the driving connection state, and the first planetary gear retreats from the driving force transmitting path of the first gear train when the first lever is located at the second angular position, whereby the first gear train is held in the non driving connection state.

According to the invention, the first planetary gear is provided at the first lever and is located at the driving force transmitting path of the first gear train when the first lever is located at the first angular position. When the first lever is located at the second angular position on the other hand, the first planetary gear retreats from the driving force transmitting path of the first gear train. Accordingly, it is possible to hold the first gear train selectively in the driving connection state or the non driving connection state by swinging and moving the first lever.

The invention is also characterized in that a second lever is provided swingably between the connected position and the disconnected position with respect to the second gear train, a second planetary gear which composes a part of the second gear train is attached rotatably to the second lever, the second planetary gear is positioned in the driving force transmitting path of the second gear train when the second lever is located at the connected position, whereby the second gear train is held in the driving connection state, and the second planetary gear retreats from the driving force transmitting path of the second gear train when the second lever is located at the disconnected position, whereby the second gear train is held in the non driving connection state.

According to the invention, the second planetary gear is provided at the second lever, the second planetary gear is positioned in the driving force transmitting path of the second gear train when the second lever is located at the connected position and the second planetary gear retreats from the driving force transmitting path of the second gear train when the second lever is located at the disconnected position. Accordingly, it is possible to hold the second gear train selectively in the driving connection state or the non driving connection state by swinging and moving the second lever.

The invention is also characterized in that a cam member for rotating the first and second levers is provided, the first lever is located at the first angular position and the second lever is located at the disconnected position when the cam member is located at a first position, and the first lever is located at the second angular position and the second lever is located at the connected position when the cam member is located at a second position.

According to the invention, the first and second levers are rotated by the move of the cam member and the first gear train is held in the driving connection state and the second gear train is held in the non driving connection state when the cam member is located at the first position. The first gear train is held in the non driving connection state and the second gear train is held in the driving connection state when the cam member is located at the second position. Accordingly, it is possible to drive and control the first and second gear trains as required with a relatively simple arrangement by using the cam member.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
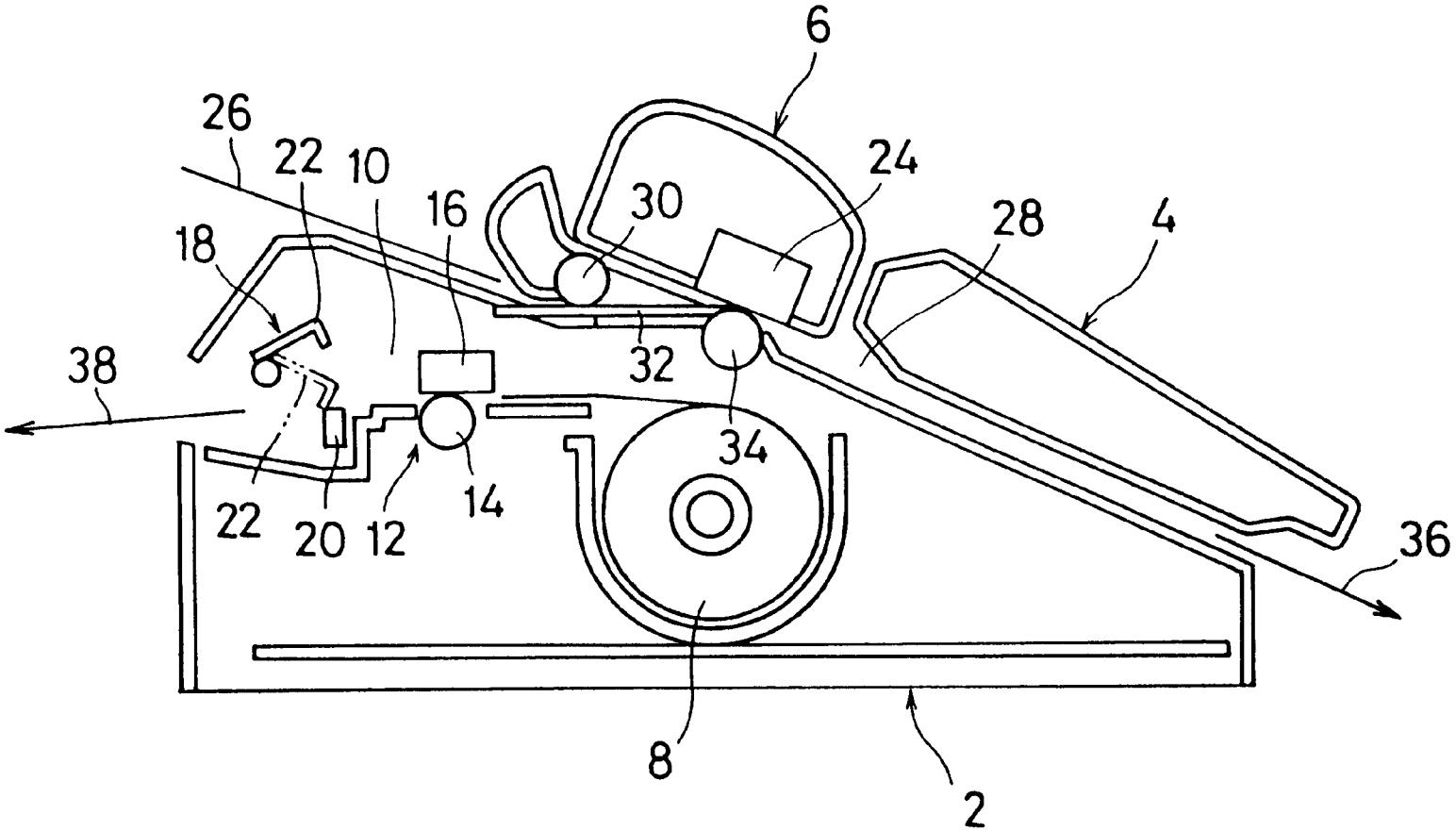
FIG. 1 is a section view schematically showing an example of a facsimile equipped with an embodiment of an apparatus for feeding rolled paper of the present invention.

Now referring to the drawings, preferred embodiments of the invention are described below.

FIG. 1 is a section view schematically showing a facsimile comprising one example of an apparatus for feeding rolled paper of the present invention. In FIG. 1, the facsimile comprises a facsimile main body 2 and a panel unit 4 and a scanner unit 6 provided above the facsimile main body 2. A roll of paper 8 is rotatably supported in the facsimile main body 2 and is fed through a paper feeding path 10 defined in the facsimile main body 2. A feed mechanism 12 for feeding the rolled paper 8 is disposed in the paper feeding path 10. The feed mechanism 12 shown in the figure comprises a feed roller 14 which is driven and rotated in a predetermined direction as well as in a direction opposite to the predetermined direction as described later. A recording head 16 is disposed facing to the feed roller 14. The recording head 16 records information to be recorded (information corresponding received signals in a receiving mode and information corresponding to an original to be copied in a copy mode for example) on the surface of the paper interposed between it and the feed roller 14. A cutting unit 18 is disposed on the downstream side of the feed roller 14. The cutting unit 18 shown in the figure has a fixed cutter 20 and a movable cutter 22 disposed thereabove. The movable cutter 22 is capable of moving between a non-cutting position indicated by a solid line and a cutting position indicated by an alternate dotted line in FIG. 1 as described later.

A control panel not shown is disposed on the surface of the panel unit 4. Various switches for operating the facsimile are provided on the control panel. A reading head 24 is provided in the scanner unit 6.

An original feeding path 28 for feeding an original 26 is provided between the facsimile main body 2 and the panel unit 4 as well as the scanner unit 6. An original supplying roller 30 is disposed above the original feeding path 28 and a separating member 32 which cooperates with the original supplying roller 30 is disposed below that. The original supplying roller 30 and the separating member 32 are mounted in the facsimile main body 2 and the original 26 (original to be transmitted or to be copied) is fed between the original supplying roller 30 and the separating member 32. An original feeding roller 34 for feeding the original 26 along the original feeding path 28 is disposed below the reading head 24. The reading head 24 reads information on the original 26 positioned between the original feeding roller 34 and the reading head 24.

This facsimile operates in various modes as follows. During a transmission mode, the tip end portion of the original 26 to be transmitted is placed on the separating member 32 and the original 26 is fed to the original feeding path 28 one by one by the work of the original supplying roller 30. The original 26 fed to the original feeding path 28 is fed further to the downstream side by the original feeding roller 34 and the reading head 24 reads its information. Then, the original 26 is discharged out of the original feeding path 28 as indicated by an arrow 36. During a receiving mode, the feed roller 14 is driven and rotated in the predetermined direction and thereby the rolled paper 8 is fed through the paper feeding path 10. Information received by the receiving head 16 is recorded on the paper fed through the paper feeding path 10 and the paper on which the information has been recorded is fed further to the downstream side. The paper fed through the paper feeding path 10 is cut into a predetermined length by the cutting unit 18 as described later and is discharged out of the paper feeding path 10 as indicated by an arrow 38. Further in a copy mode, the tip end portion of the original 26 to be copied is placed on the separating member 32 and is fed through the original feeding path 28 by the work of the original supplying roller 30 and the original feeding roller 34. Further, the rolled paper 8 is fed through the paper feeding path 10 by the work of the feed roller 14. Then, information on the original read by the reading head 24 is recorded on the paper by the work of the recording head 16 and the paper is fed out of the paper feeding path 10 after being cut by the cutting unit 18.

Figure 2:
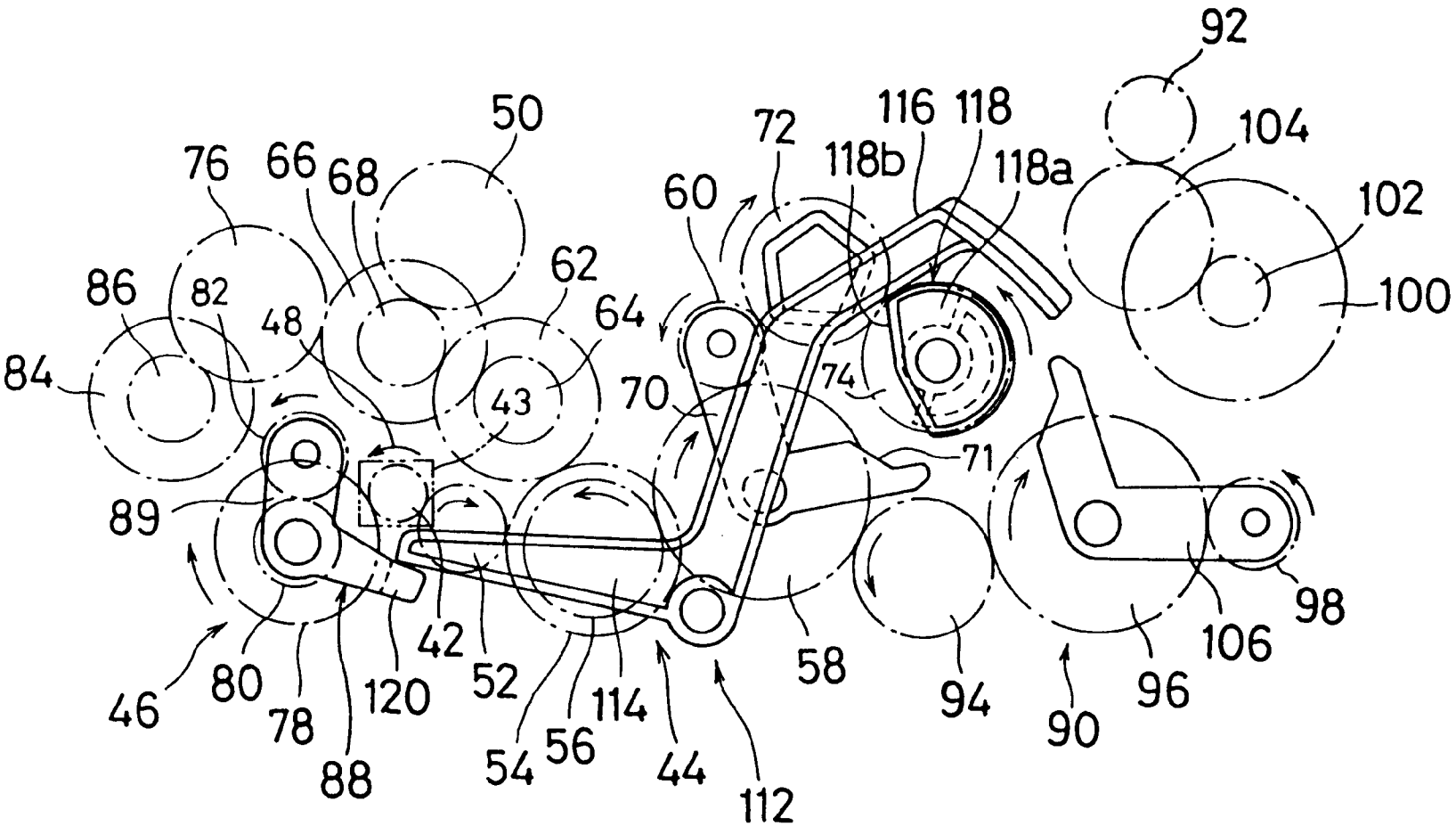
FIG. 2 is a front view schematically showing a driving system in the facsimile in FIG. 1.

The above-mentioned facsimile is driven by a driving system shown in FIG. 2. As shown in FIG. 2, the driving system comprises a driving gear 42, a first gear train 44 and a second gear train 46. The driving gear 42 is fixed to an output shaft of a driving motor 43 constituting a driving source of the facsimile and is rotatively driven selectively in directions indicated by arrows 48 (FIG. 2) and 49 (FIG. 3) in a body with this output shaft. The first gear train 44 includes a feed gear 50 which is rotatively driven in a body with the feed roller 14. Interposed between the driving gear 42 and the feed gear 50 are a gear 52 engaging with the driving gear 42, a gear 54 engaging the gear 52, a gear 56 formed in a body with the gear 54, a gear 58 engaging with the gear 56, a planetary gear 60 (which forms a first planetary gear) engaging with the gear 58, a gear 62 engaging with the planetary gear 60 in a manner capable of being connected/disconnected with/from it, a gear 64 formed in a body with the gear 62, a gear 66 engaging with the gear 64 and a gear 68 formed in a body with the gear 66. These gears 64 through 68 also compose the first gear train 44 and the gear 68 engages with the feed gear 50. A first lever 70 is attached rotatably to a supporting shaft of the gear 58 and the planetary gear 60 is attached rotatably to the first lever 70. When the first lever 70 is located at a predetermined angular position as shown in FIG. 2, the planetary gear 60 retreats from a driving force transmitting path of the first gear train 44 and engages with a cam gear 72 in a manner capable of being connected/disconnected with/from it. The driving force from the driving gear 42 is then transmitted to the cam gear 72, and to a cam gear 74 engaging with it, via the gears 52, 54, 56, 58 and the planetary gear 60 and when the driving gear 42 rotates in the direction indicated by an arrow 48, those gears 52 through 60 and the gears 72 and 74 rotate in the directions indicated by respective arrows. At this time, the planetary gear 60 is disconnected from the above-mentioned driving force transmitting path and is released from the engagement with the gear 64, so that no driving force is transmitted to the feed gear 50. When the planetary gear 60 moves along the periphery of the gear 58 and is located in the above-mentioned driving force transmitting path on the other hand, it engages with the gear 62 and the driving force from the driving gear 42 is transmitted to the feed gear 50 via the gears 52 through 68. At this time, the first lever 70 is held at a first angular position shown in FIG. 3. Further, because the engagement of the planetary gear 60 with the cam gear 72 is released, the cam gears 72 and 74 will not be rotatively driven.

The second gear train 46 includes a cutter gear 76 linked with the movable cutter 22. Interposed between the driving gear 42 and the cutter gear 76 are a gear 78 engaging with the driving gear 42, a gear 80 formed in a body with the gear 78, a planetary gear 82 engaging with the gear 80 (which forms a second planetary gear), a gear 84 engaging with the planetary gear 82 in a manner capable of being connected/disconnected with/from it and a gear 86 formed in a body with the gear 84. These gears 78 through 86 also compose the second gear train 46 and the gear 86 engages with the cutter gear 76. A second lever 88 is attached rotatably to a supporting shaft of the gear 78 and the planetary gear 82 is attached rotatably to a first lever portion 89 of the second lever 88. When the second lever 88 is located at a disconnect position shown in FIG. 2, the planetary gear 82 retreats from a driving force transmitting path of the second gear train 46 and is released from the gear 84. Accordingly, no driving force is transmitted from the driving gear 42 to the cutter gear 76. When the planetary gear 82 moves along the periphery of the gear 80 and the second lever 88 is located at a connected position shown in FIG. 4, the planetary gear 82 is positioned in the driving force transmitting path of the second gear train 46. That is, it is connected with the gear 84 and the driving force from the driving gear 42 is transmitted to the cutter gear 76 via the gears 78 through 86.

In the embodiment shown in the figures, a third gear train 90 is disposed in connection with the gear 58 in the first gear train 44. The third gear train 90 includes an original feeding gear 92 which rotates in a body with the original feeding roller 34. Interposed between the gear 58 and the original feed gear 92 are a gear 94 engaging with the gear 58, a gear 96 engaging with the gear 94, a planetary gear 98 engaging with the gear 96, a gear 100 engaging with the planetary gear 98 in a manner capable of being connected/disconnected with/from it, a gear 102 formed in a body with the gear 100 and a gear 104 engaging with the gear 102. These gears 94 through 104 also compose the third gear train 90 and the gear 104 engages with the original feed gear 92 described above. A third lever 106 is attached rotatably to a supporting shaft of the gear 96 and the gear 98 is rotatably supported at a tip end of the third lever 106. When the third lever is located at a position shown in FIG. 2, the gear 98 is released from the engagement with the gear 100 and the driving force from the gear 58, i.e. from the driving gear 42, is not transmitted to the original feed gear 92. When the planetary gear 98 moves along the periphery of the gear 96 and is connected with the gear 100, the driving force from the gear 58 is transmitted to the original feed gear 92 via the gears 94 through 104.

The facsimile main body 2 is also provided with an arm member 112 attached swingably thereto. The arm member 112 has a first arm portion 114 which extends toward the second lever 88 and a second arm portion 116 which extends toward the cam gear 74. The cam gear 74 is also provided with a cam member 118 which rotates in a body with it and the second arm portion 116 of the arm member 112 abuts against the outer peripheral face of the cam member 118. Accordingly, the tip end portion of the first arm portion 114 of the arm member 112 works on a second lever portion 120 of the second lever 88 at the first angular position (angular position shown in FIGS. 2 and 3) where the second arm portion 116 of the arm member 112 works on a cam circular portion 118a of the cam member 118. The second lever portion 120 of the second lever 88 extends toward the first arm portion 114, so that when the first arm portion 114 of the arm member 112 works on it, the second lever 88 is blocked from rotating counterclockwise in FIG. 2 and is held at the disconnect position, thus blocking the planetary gear 82 from being connected with the gear 84. When the second arm portion 116 of the arm member 112 is located at a second angular position (angular position shown in FIG. 4) where it works on a cam concave section 118b of the cam member 118 on the other hand, the arm member 112 rotates clockwise from the first angular position in FIG. 2 and the first arm portion 114 of the arm member 112 retreats from the moving path of the second lever portion 120 of the second lever 88. Thereby, the second lever 88 is permitted to rotate clockwise in FIG. 2 and is located at the above-mentioned connected position, connecting the planetary gear 82 with the gear 84.

Figure 5:
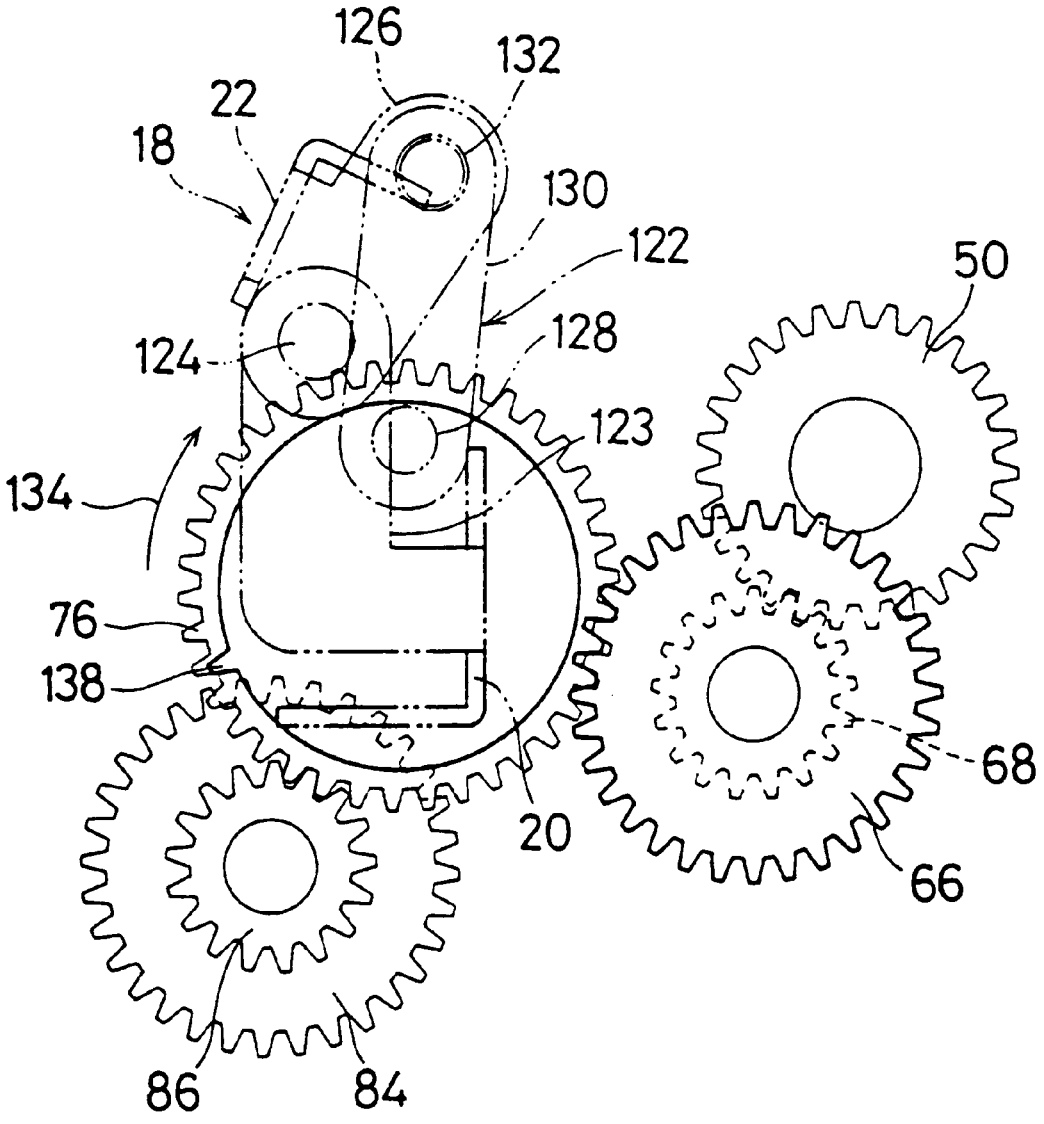
FIG. 5 is an enlarged side view showing cutting means and components related thereto when a movable cutter is located at a non-cutting position in the facsimile in FIG. 1.

In the present embodiment, the cutter gear 76 is linked with the movable cutter 22 via a link mechanism 122 as shown in FIG. 5. A bracket 123 is attached to the facsimile main body 2 and one end of a first link 126 is attached rotatably to the bracket 123 via a supporting shaft 124. The movable cutter 22 is fixed to the first link 126. The link mechanism 122 also comprises a fixed pin 128 which rotates in a body with the cutter gear 76. One end of a second link 130 is attached rotatably to the fixed pin 128 and the other ends of the first and second links 126 and 130 are rotatably linked via a connecting pin 132. Although the fixed pin 128 is fixed to the cutter gear 76 eccentrically from the center of rotation thereof, it may be provided on a reverse feed gear described later depending on a configuration of the gears in the gear trains 44 and 46. It is noted that the fixed cutter 20 is attached to the above-mentioned bracket 123.

Because the cutting unit is constructed as described above, the movable cutter 22 is held at the non-cutting position located above the fixed cutter 20 and will not work on the paper fed through the paper feeding path 10 (see FIG. 1) when the cutter gear 76 is located at the position shown in FIG. 5. When the cutter gear 76 rotates by about 180 degrees in the direction indicated by an arrow 134 from this angular position, the fixed pin 128 moves and the first link 126 pivots clockwise via the second link 130 centering on the supporting shaft 124 in FIG. 5. Thereby, the movable cutter 22 rotates downward to the fixed cutter 20 to the cutting position shown in FIG. 6 centering on the supporting shaft 124. When the movable cutter 22 thus moves, the fixed cutter 20 and the movable cutter 22 work on the paper in the paper feeding path 10, cutting the rolled paper 8 into a sheet of desired length. After cutting the rolled paper 8, the cutter gear 76 rotates in the direction indicated by the arrow 134 to the original angular position (the angular position shown in FIG. 5) beyond the angular position shown in FIG. 6. When it rotates to the position shown in FIG. 5, it returns to the original non-cutting position.

The reverse feed gear 136 (this reverse feed gear is omitted in FIGS. 2 through 4) is interposed between the second gear train 46 and the first gear train 44. In the embodiment shown in the figure, the reverse feed gear 136 is formed in a body with the cutter gear 76. As shown in FIG. 5, the reverse feed gear 136 is provided, at part thereof, with a tooth portion which is composed of one tooth 138 in the present embodiment. The reverse feed gear 136 is capable of engaging with the gear 66 in the first gear train 44 and when the both gears 136 and 66 engages, the driving force from the cutter gear 76 in the second gear train 46 is transmitted to the gear 66 in the first gear train 44 via the reverse feed gear 136 and is transmitted further to the feed gear 50 via the gear 68 as described later.

In the driving system comprising the reverse feed gear 136 as described above, the feed roller 14 is rotated slightly in the direction opposite to the predetermined direction by the work of the reverse feed gear 136 and thereby the tip end of the rolled paper 8 is pulled in slightly from the cutting position (where the fixed cutter 20 acts with the movable cutter 22) when the movable cutter 22 returns from the cutting position to the non-cutting position after cutting the paper. More specifically, in the receiving mode during which the rolled paper 8 is fed through the paper feeding path 10 for example, the driving system is held in the state shown in FIG. 3. That is, the cam member 118 is located at the first position shown in FIG. 3, the cam circular portion 118a of the cam member 118 which is formed in a body with the cam gear 74 works on the second arm portion 116 of the arm member 112 and the arm member 112 is held at the first angular position shown in FIG. 3. Accordingly, the first arm portion 114 of the arm member 112 works on the second lever portion 120 of the second lever 88 and rotates it counterclockwise, holding the second lever 88 in the disconnected position shown in FIG. 3. In this state, the planetary gear 82 is separated from the gear 84, retreating from the driving force transmitting path of the second gear train 46. Thereby, the link between the planetary gear 82 and the gear 84 is released and the second gear train 46 is held in the connection release state.

Figure 3:
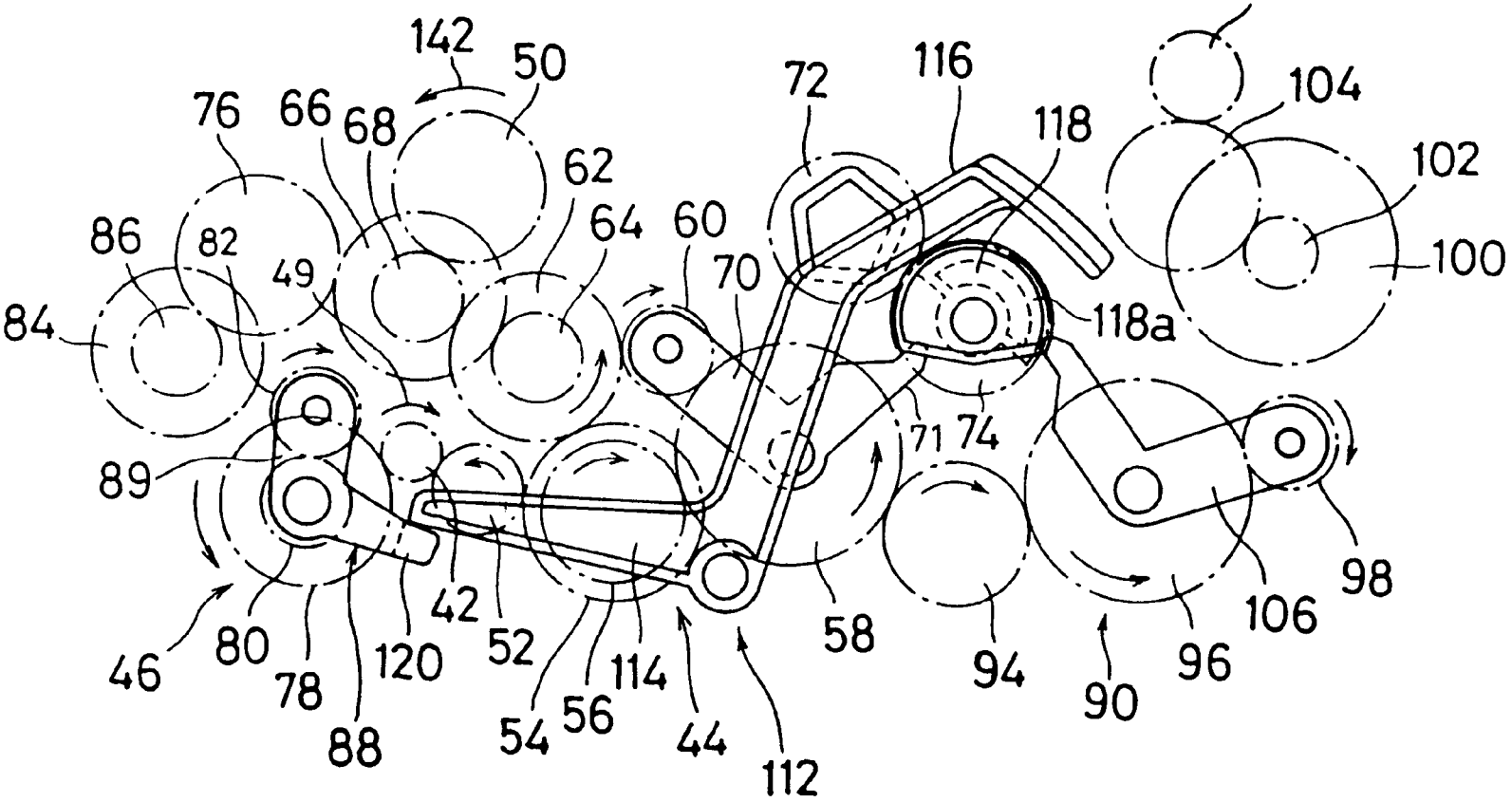
FIG. 3 is a front view of the driving system in FIG. 2 in a receiving mode.

When the driving motor 43 (see FIG. 2) normally rotates and the driving gear 42 rotates in the direction indicated by an arrow 49 in this state, the gear 58 is rotated via the gears 52, 54 and 56, the planetary gear 60 moves along the outer periphery of the gear 58 as the gear 58 rotates and is connected with the gear 62. Thereby, the first lever 70 is held at the first angular position shown in FIG. 3 and the feed gear 50 is rotated in the direction indicated by an arrow 142 via the gears 64, 66 and 68. Accordingly, the feed gear 50 is driven and rotated by the driving force from the driving gear 42, the feed roller 14 is rotated in the predetermined direction and the rolled paper 8 is fed along the paper feeding path 10. At this time, each gear is rotated in the direction indicated by the respective arrows in FIG. 3. In FIG. 3, the rotating direction of the gears rotated during the receiving mode is indicated by the arrows. That is, because the second gear train 46 is held in the driving connection release state, although the driving force from the driving gear 42 is transmitted to the gears 78, 80 and 82, it is not transmitted to the gears 84 and 86 and to the cutter gear 76. Therefore, the movable cutter 22 of the cutting unit 18 is held at the non-cutting position shown in FIG. 5. Further, because the third gear train 90 is held in the driving connection release state, although the driving force from the gear 58 is transmitted to the gears 94, 96 and 98, it is not transmitted to the gears 100, 102 and 104 and to the original feed gear 92. Therefore, the original feeding roller 34 is not rotated.

Figure 4:
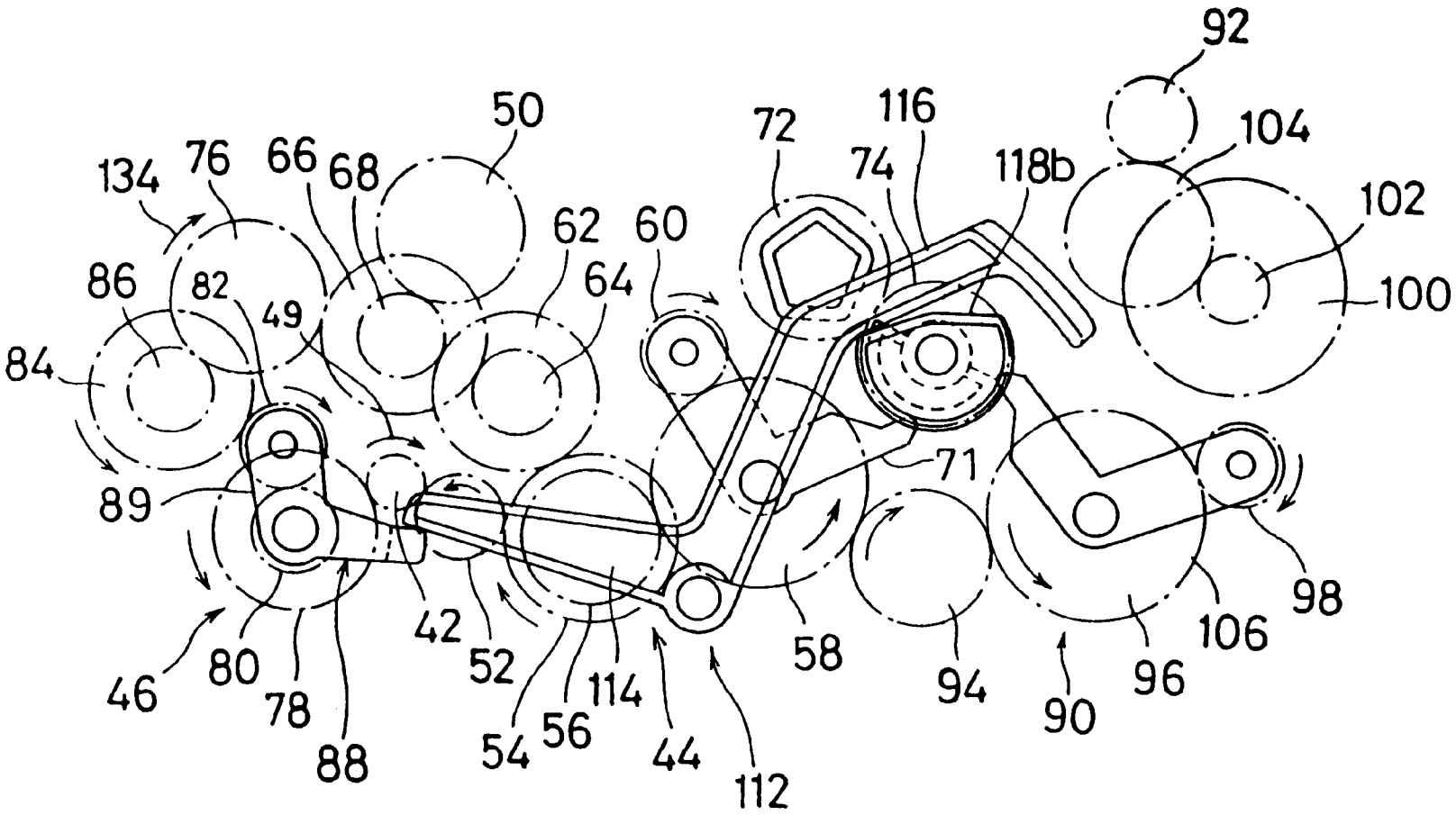
FIG. 4 is a front view of the driving system in FIG. 2 in a cutter driving mode.

When the paper pulled out of the rolled paper 8 is to be cut, the mode is switched to a cutting drive mode shown in FIG. 4. In switching to the cutting drive mode, the first lever 70 is first rotated counter clockwise in FIG. 3 by the work of an actuating mechanism not shown, the planetary gear 60 engages with the cam gear 72 and the cam gear 74 is then rotated clockwise to the angular position as shown in FIG. 4. In this cutting drive mode, the driving system is held in the state shown in FIG. 4. That is, the cam member 118 is located at the second position shown in FIG. 4, the cam concave portion 118b of the cam member 118 works on the second arm portion 116 of the arm member 112 and the arm member 112 is held at the second angular position shown in FIG. 4. Accordingly, the first arm portion 114 of the arm member 112 retreats from the second lever portion 120 of the second lever 88, permitting the second lever 88 to rotate to the connected position shown in FIG. 4. Further, the cam circular portion 118a of the cam member 118 works on the lever portion 71 of the first lever 70, so that the first lever 70 is held at the second angular position shown in FIG. 4. In the second angular position, the planetary gear 60 is released from the cam gear 72 and is held between the cam gear 72 and the gear 62. In this state, the planetary gear 60 retreats also from the driving force transmitting path of the first gear train 44 and is disconnected from the gear 62, so that the first gear train 44 is held in the connection release state.

When the driving motor not shown rotates normally and the driving gear 42 is driven in the direction indicated by the arrow 49 in this state, the gear 80 is rotated via the gear 78, the planetary gear 82 moves along the outer periphery of the gear 80 and is linked with the gear 84 as the gear 80 rotates. Thereby, the second lever 88 is held at the connected position shown in FIG. 4 and the cutter gear 76 is rotated in the direction indicated by an arrow 134 via the gear 86. Accordingly, the cutter gear 76 is rotated by the driving force from the driving gear 42 and the movable cutter 22 is moved from the non-cutting position shown in FIG. 5 to the cutting position shown in FIG. 6. At this time, each gear is rotated in the direction indicated by the respective arrows in FIG. 4. In FIG. 4, the rotating directions of the gears driven during the cutting drive mode are indicated by the respective arrows. That is, because the first gear train 44 is held in the driving connection release state, although the driving force from the driving gear 42 is transmitted to the gears 52, 54, 56, 58 and 60, it is not transmitted to the gears 62, 64, 66 and 68 as well as to the feed gear 50. Accordingly, the feed roller 14 is not rotated and the rolled paper 8 is stopped from being fed. Further, because the third gear train 90 is held in the driving connection release state, although the driving force from the gear 58 is transmitted to the gears 94, 96 and 98, it is not transmitted to the gears 100, 102 and 104 as well as to the original feed gear 92.

Figure 6:
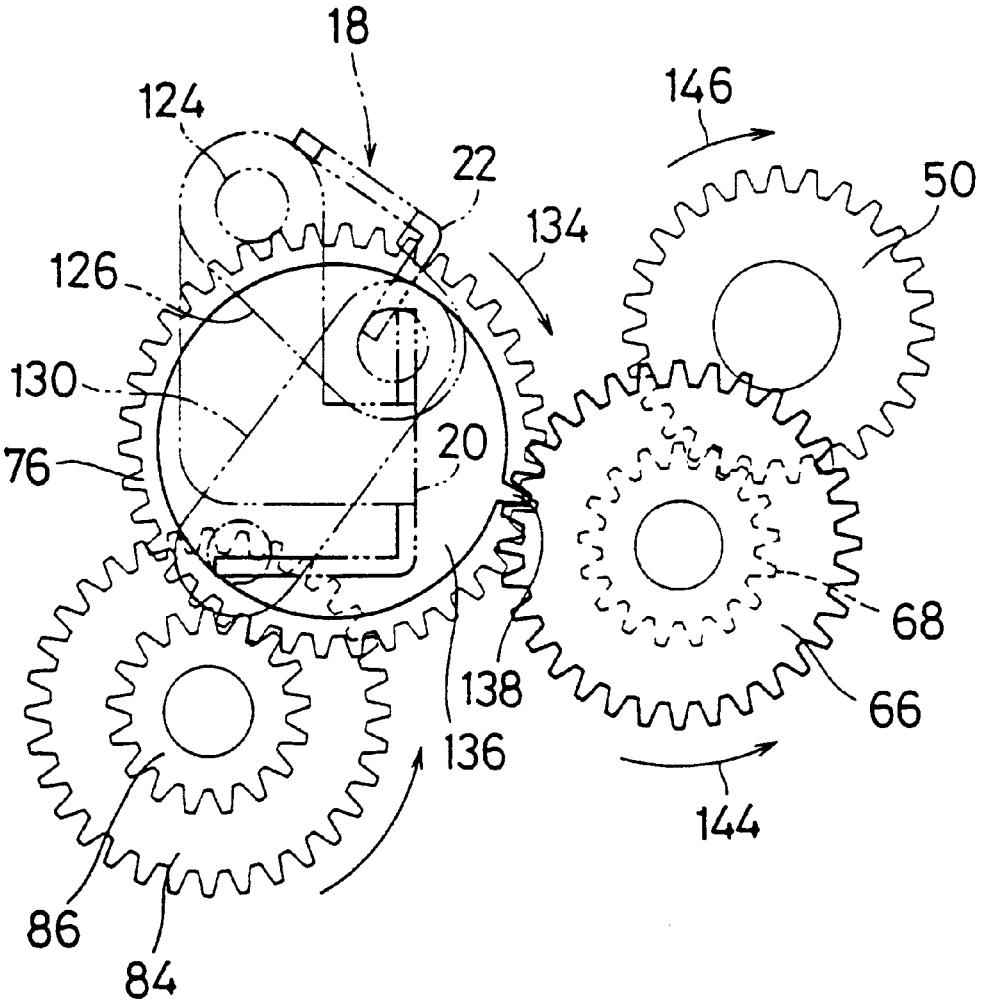
FIG. 6 is an enlarged side view corresponding to FIG. 5, showing a state when the movable cutter is located at a cutting position.

Because the tooth 138 of the reverse feed gear 136 is located almost at the opposite side from the gear 66 of the first gear train 44 as shown in FIG. 5 in the initial period of the cutting drive mode, the driving force to the cutter gear 76 is not transmitted further to the above-mentioned gear 66. When the cutter gear 76 rotates by about 180 degrees in the direction shown by the arrow 134 to the angular position shown in FIG. 6 in this cutting drive mode, the movable cutter 22 rotates from the non-cutting position to the cutting position shown in FIG. 6. Thereby, the paper positioned in the paper feeding path 10 is cut as desired. When the cutter gear 76 rotates by about 180 degrees, the tooth 138 of the reverse feed gear 136 engages with the tooth portion of the gear 66 as shown in FIG. 6 and rotates the gear 66 slightly in the direction indicated by an arrow 44. This rotating force is transmitted to the feed gear 50 via the gear 68. Accordingly, when the movable cutter 22 cuts the rolled paper 8 by moving to the cutting position, the feed gear 50 is rotated slightly in the direction opposite to the predetermined direction indicated by an arrow 146 by the driving force for the cutter gear 76. Thereby, the tip end of the rolled paper 8 is pulled in slightly from the cutting position. Because the tip end of the rolled paper 8 is pulled in via the reverse feed gear 136, it may be pulled in very accurately and reliably.

When the cutter gear 76 rotates further, the movable cutter 22 returns from the above-mentioned cutting position to the non-cutting position shown in FIG. 5. Because the tip end of the rolled paper 8 has been pulled in slightly from the cutting position, the tip end will not work on the movable cutter 22. It is noted that since the reverse feed gear 136 has only one tooth 138, a period during which the reverse feed gear 136 is connected with the gear 66 is short. Accordingly, an amount of move by which the tip end of the rolled paper 8 is pulled in is a minimum required amount. Thus, the rolled paper 8 may be cut by the cutting unit 18 and may be pulled in by the series of operations of one rotation of the cutter gear 76. It is noted that the timing for pulling in the rolled paper 8 may be controlled by adequately setting the position of the tooth 138 provided on the reverse feed gear 136. Further, the amount of move by which the rolled paper 8 is pulled in may be controlled by adequately setting a number of teeth provided on the reverse feed gear 136.

In the present embodiment, the cutter gear 76 rotates once during the cutting drive mode and when it finishes to rotate once, the cutting drive mode is finished and the driving motor 43 is de-energized.

While one embodiment of the apparatus feeding rolled paper of the invention has been explained, it may be varied or modified as follows.

For instance, although the reverse feed gear 136 has been provided in a body with the cutter gear 76 of the second gear train 46 in the embodiment described above, it may be provided in connection with another gear in the second gear train 46.

Further, although the inventive apparatus for feeding rolled paper has been explained by applying it to the facsimile in the embodiment described above, it is applicable equally to another recording apparatus such as a printer and a copier.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An apparatus for feeding rolled paper comprising:

rolled paper; a feed mechanism for feeding a portion of the rolled paper in a predetermined direction; a cutting unit for cutting the portion of the rolled paper into a sheet of desired length; a driving source for actuating the feed mechanism and the cutting unit; a first gear train interposed between the driving source and the feed mechanism; and a second gear train interposed between the driving source and the cutting unit, wherein the first gear train includes a feed gear for driving the feed mechanism;

wherein the second gear train includes a cutter gear for moving a movable cutter of the cutting unit between a non-cutting position and a cutting position; and a reverse feed gear comprising an integral part of the cutter gear for transmitting driving force for the cutter gear to the feed gear interposed between the first gear train and the second gear train;

the apparatus being operable such that when the portion of the rolled paper is to be fed, the second gear train is held in a non driving connection state and the first gear train is held in a driving connection state, thereby transmitting the driving force from the driving source to the feed mechanism via the first gear train and rotatively driving the feed mechanism in the predetermined direction;

when the portion of the rolled paper is to be cut, the second gear train is held in a driving connection state and the first gear train is held in a non driving connection state, thereby transmitting the driving force from the driving source to the movable cutter via the second gear train and moving the movable cutter from the non-cutting position to the cutting position and then from the cutting position to the non-cutting position; and when the movable cutter moves from the cutting position to the non-cutting position, the reverse feed gear connects the first gear train with the second gear train, thereby transmitting the driving force for the cutter gear to the feed gear via the reverse feed gear and rotatively driving the feed mechanism in a direction opposite to the predetermined direction.

2. The apparatus for feeding rolled paper of claim 1, wherein the reverse feed gear includes a tooth portion which is drivingly connected with the first gear train, and the feed mechanism is rotatively driven in the direction opposite to the predetermined direction while the tooth portion of the reverse feed gear is connected with the first gear train.

3. The apparatus for feeding rolled paper of claim 1, wherein the reverse feed gear includes one tooth, and when the one tooth engages with the first gear train, the feed mechanism is rotatively driven in the direction opposite to the predetermined direction.

4. The apparatus for feeding rolled paper of claim 1, wherein a link mechanism is interposed between the cutter gear and the movable cutter of the cutting unit, and when the cutter gear is rotated once by the driving force from the second gear train, the movable cutter moves from the non-cutting position to the cutting position and then returns to the non-cutting position via the link mechanism.

5. The apparatus for feeding rolled paper of claim 1, wherein a first lever is provided swingably between a first angular position and a second angular position with respect to the first gear train, a first planetary gear composing a part of the first gear train is attached rotatably to the first lever, when the first lever is located at the first angular position, the first planetary gear is positioned in the driving force transmitting path of the first gear train, whereby the first gear train is held in the driving connection state, and when the first lever is located at the second angular position, the first planetary gear retreats from the driving force transmitting path of the first gear train, whereby the first gear train is held in the non driving connection state.

6. The apparatus for feeding rolled paper of claim 5, wherein a second lever is provided swingably between a connected position and a disconnected position with respect to the second gear train, a second planetary gear which composes a part of the second gear train is attached rotatably to the second lever, when the second lever is located at the connected position, the second planetary gear is positioned in the driving force transmitting path of the s econd gear train, whereby the second gear train is held in the driving connection state, and when the second lever is located at the disconnected position, the second planetary gear retreats from the driving force transmitting path of the second gear train, whereby the second gear train is held in the non driving connection state.

7. The apparatus for feeding rolled paper of claim 6, wherein a cam member for rotating the first and second levers is provided, when the cam member is located at a first position, the first lever is located at the first angular position and the second lever is located at the disconnected position, and when the cam member is located at a second position, the first lever is located at the second angular position and the second lever is located at the connected position.

8. An apparatus for feeding rolled paper comprising:

a feed mechanism for feeding an outer end portion of rolled paper in a predetermined direction; a cutting unit for cutting said outer end portion of the rolled paper into a sheet of desired length; a driving source for actuating the feed mechanism and the cutting unit; a first gear train interposed between the driving source and the feed mechanism; and a second gear train interposed between the driving source and the cutting unit, wherein the first gear train includes a feed gear for driving the feed mechanism;

the second gear train includes a cutter gear for moving a movable cutter of the cutting unit between a non-cutting position and a cutting position;

a reverse feed gear for transmitting driving force for the cutter gear to the feed gear is interposed between the first gear train and the second gear train and wherein the reverse feed gear is driven in a body with the cutter gear, a part of which includes a tooth portion which is drivingly connected with the first gear train;

when said outer end portion of the rolled paper is to be fed, the second gear train is held in a non driving connection state and the first gear train is held in a driving connection state, thereby transmitting the driving force from the driving source to the feed mechanism via the first gear train and rotatively driving the feed mechanism in the predetermined direction;

when said outer end portion of the rolled paper is to be cut, the second gear train is held in a driving connection state and the first gear train is held in a non driving connection state, thereby transmitting the driving force from the driving source to the movable cutter via the second gear train and moving the movable cutter from the non-cutting position to the cutting position and then from the cutting position to the non-cutting position; and when the movable cutter moves from the cutting position to the non-cutting position, the reverse feed gear connects the first gear train with the second gear train by means of said tooth portion, thereby transmitting the driving force for the cutter gear to the feed gear via the tooth portion and rotatively driving the feed mechanism in a direction opposite to the predetermined direction while the tooth portion of the reverse feed gear is connected with the first gear train, thereby preventing a tip end of the outer end portion of the rolled paper from abutting the movable cutter.

9. The apparatus for feeding rolled paper of claim 8, wherein the tooth portion includes one tooth, and when the one tooth engages with the first gear train, the feed mechanism is rotatively driven in the direction opposite to the predetermined direction by said one tooth.

* * * * *